United States Patent [19]

Anderson

[11] Patent Number: 4,821,305

[45] Date of Patent: Apr. 11, 1989

[54] PHOTOELECTRIC X-RAY TUBE

[75] Inventor: Weston A. Anderson, Palo Alto, Calif.

[73] Assignee: Varian Associates, Inc., Palo Alto, Calif.

[21] Appl. No.: 207,005

[22] Filed: Jun. 9, 1988

Related U.S. Application Data

[63] Continuation of Ser. No. 843,960, Mar. 25, 1986, abandoned.

[51] Int. Cl.[4] ..... H01J 35/06

[52] U.S. Cl. ..... 378/136; 378/125; 378/144; 378/142

[58] Field of Search ..... 378/121, 125, 127, 136, 378/141, 144, 142

[56] References Cited

U.S. PATENT DOCUMENTS

| | | | |
|---|---|---|---|
| 2,111,412 | 3/1938 | Ungelenk . | |
| 2,229,152 | 1/1941 | Walsweer . | |
| 2,493,606 | 1/1950 | Waterton . | |
| 2,900,543 | 8/1959 | Heuse | 378/144 |
| 3,992,633 | 11/1976 | Braun et al. . | |
| 4,068,127 | 1/1978 | Goodenough . | |
| 4,165,472 | 8/1979 | Wittry | 378/127 |
| 4,229,657 | 10/1980 | Bensussan et al. | 378/125 |
| 4,250,425 | 2/1981 | Gabbay et al. . | |
| 4,606,061 | 8/1986 | Ramamurti | 378/136 |
| 4,692,938 | 9/1987 | Oba | 378/136 |

FOREIGN PATENT DOCUMENTS 858417 1/1961 United Kingdom .

OTHER PUBLICATIONS

IBM Technical Disclosure Bulletin, vol. 17, No. 10, Mar. 1975, "X-Ray Tube Having Anode with Compound Motion", J. B. Gunn, pp. 3044-3046.

*Primary Examiner*—Carolyn E. Fields
*Assistant Examiner*—David P. Porta
*Attorney, Agent, or Firm*—Stanley Z. Cole; Peter J. Sgarbossa; Richard B. Nelson

[57] ABSTRACT

The average power capacity of a rotating-anode X-ray generator tube is limited by the slow radiation cooling of the anode. The invention removes this limitation by rotating the entire vacuum envelope so the heat can be conducted directly to the air or to a circulating liquid. The cathode and anode are made as figures of revolution about the axis. A stationary source of X-rays is produced by focusing a stationary spot of the light onto a rotating photocathode. The photoelectrons are drawn off and focused onto a stationary spot on the rotating anode, to produce a stationary source of X-rays.

13 Claims, 1 Drawing Sheet

PHOTOELECTRIC X-RAY TUBE

This application is a continuation of application Ser. No. 843,960, filed Mar. 25, 1986, now abandoned.

FIELD OF THE INVENTION

The invention pertains to rotating-target X-ray tubes for generating high-power, pulsed and continuous fluxes of X-rays.

Prior Art

The classic X-ray tubes have a thermionic cathode at one end and a fixed metallic anode at the other. Their power capacity is limited by the conductive cooling of the anode target by the electron beam which, must be tightly focused to provide a high-definition image.

A later advance was the rotating-target tube in which the target is the surface of a metal disc spinning rapidly on bearings inside the vacuum envelope and driven by the rotor of an electric induction motor whose stator is outside the envelope. The rotating anode spreads the heat over an annular area of the target and provides much higher power for a short operating time, as in medical radiography. The ultimate cooling of the anode is mostly by thermal radiation in the high vacuum, so these tubes are inadequate for high-duty or CW operation. One has to wait for the massive anode to slowly cool.

U.S. patent application Ser. No. 683,988 filed Dec. 12, 1984 by the inventor of the present invention describes methods by which the rotating anode is made part of the vacuum envelope while the cathode is operationally fixed in space. One method is to have the rotating thermionic cathode emit along the axis of rotation and the electron beam is then deflected by a stationary magnetic field to a stationary spot on the rotating anode. In another variation, the cathode is held stationary off-axis by hanging on bearings from the rotating envelope and being held stationary by a magnetic or gravitational field.

SUMMARY OF THE INVENTION

A purpose of the invention is to provide an X-ray tube capable of generating a high-power flux of radiation with a high duty cycle or CW operation, as desired for medical radiology or X-ray photolithography.

These purposes are fulfilled by having the whole vacuum envelope rotate with the anode. The anode being part of the vacuum envelope, it can be cooled from outside by liquid or air. The cathode also rotates. It is an axially symmetric band of photocathode surface which is illuminated by a focused, stationary spot of light entering the envelope through an axially symmetric, transparent window part of the vacuum envelope. Photoelectrons from the cathode are focused, as by a stationary magnetic field, onto a small stationary spot through which the anode rotates.

DESCRIPTION OF THE PREFERRED EMBODIMENTS

Figure 1:
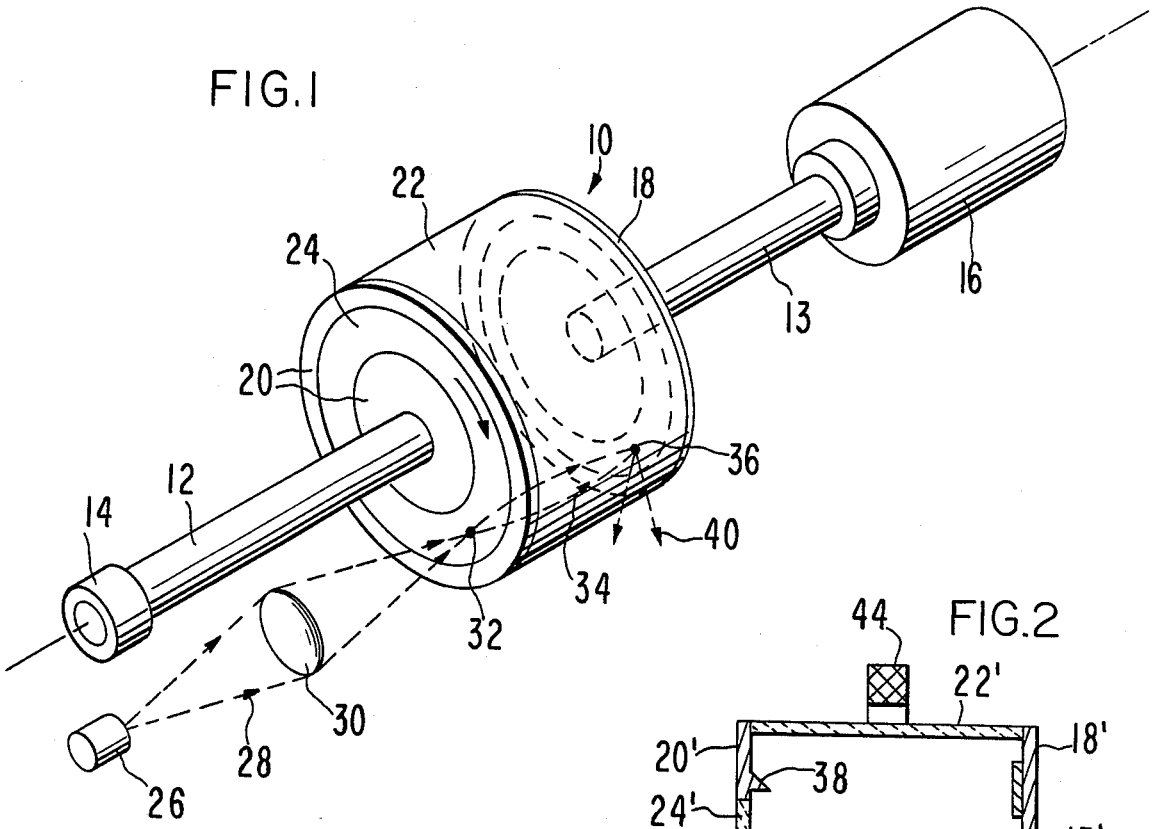
FIG. 1 is an isometric sketch of an embodiment of the invention.

FIG. 1 shows a mechanically simple embodiment of the invention. An axially symmetric rotor 10 constitutes the vacuum envelope and also the electrodes of the tube. It is connected to opposed axial shafts 12,13 which constitute the high-voltage connections to the tube. Shafts 12,13 are rotatable on one or more bearings 14 and driven by a motor 16. Rotor 10 comprises two end-plates 18,20 joined by a hollow cylindrical section 22 of the vacuum envelope. An annular section 24 of end-plate 20 is of optically transparent material such as glass or sapphire hermetically sealed to the adjacent metal parts. An external stationary light source 26 emits a beam of electromagnetic radiation 28, such as visible light. Light 28 is focused by a stationary condensing lens 30 onto a stationary region 32 through which is rotated photocathode which is held on the vacuum, inner side of window 24. Photoelectrons 34 emitted from cathode region 32 are drawn off by high positive voltage on the anode, which in this embodiment is the metallic end-plate 18 of rotor 10. Electrons 34 are focused, as by a stationary, generally axial magnetic field (not shown) onto a stationary anode spot 36 through which plate 18 is rotated. Alternatively, electrostatic or proximity focusing may be used. X-rays 40 emitted from spot 36 pass out through a vacuum window, which in this embodiment is a band on cylindrical rotor element 22. Cylinder 22 may also be the high-voltage insulator between cathode end-plate 20 and anode end-plate 18. It would typically be of high-alumina ceramic which has good X-ray transmissivity. Heat from anode plate 18 is carried off by the surrounding air. Alternatively, liquid coolant may be circulated through channels in shaft 13, requiring only a liquid-tight rotating seal instead of a vacuum-tight one.

Figure 2:
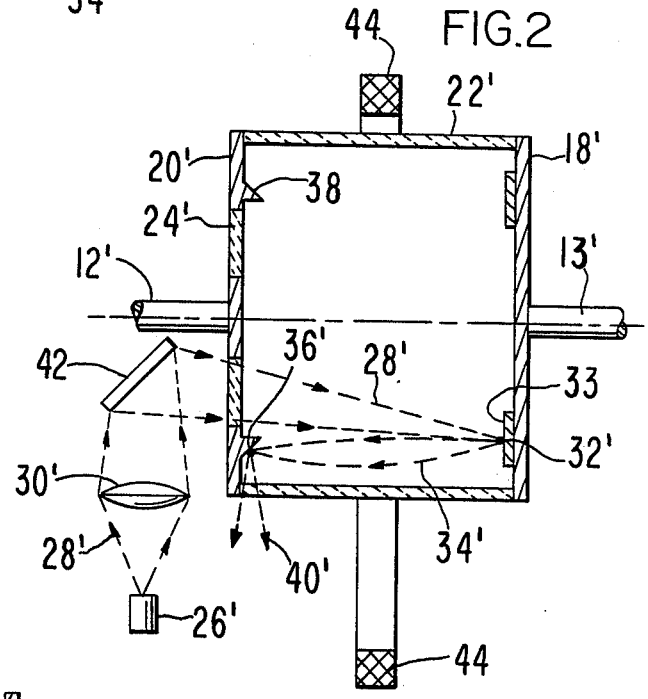
FIG. 2 is an axial section of part of a different embodiment.

FIG. 2 illustrates a slightly different embodiment. The photocathode surface 33 is formed as an annular ring on end-plate 18' which is the cathode electrode in this embodiment. Light 28' is focused with the help of a mirror 42 onto a stationary region 32' through which photocathode 33 rotates. Electrons 34' are drawn back to end-plate 20' which is now the anode electrode. They are focused onto a stationary spot 36' through which conical anode surface 38 rotates. Surface 38 is slanted as well known in the art for maximum radiated flux in the desired direction. The electrons are focused by an essentially axial magnetic field produced by an external coil 44, as known in the art of electron optics. Alternatively, electrostatic or proximity focusing may be used.

Figure 3:
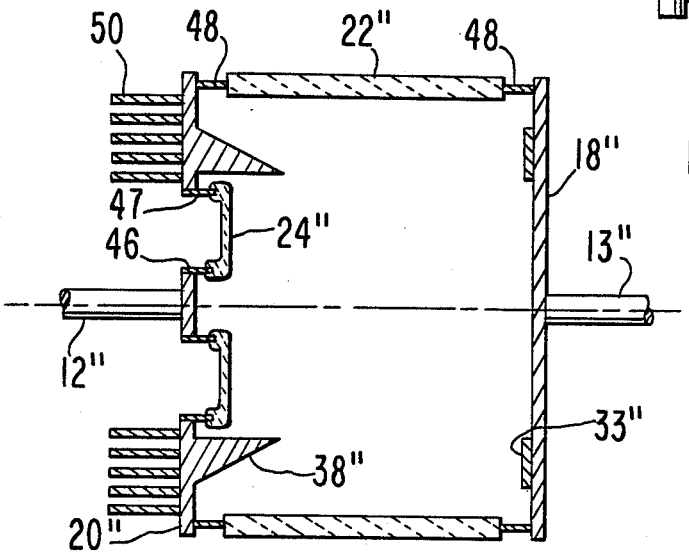
FIG. 3 is an axial section of an alternative construction of the rotor.

FIG. 3 is a section of an alternative rotor with different constructional features. Window 24'', as of glass, is sealed between coaxial, axially extending flanges 46,47 of metal adapted for sealing to glass, such as certain iron-nickel-cobalt alloys sold under trademarks such as "Kovar". High-voltage insulating cylinder 22'' is sealed by brazing its metalized ends to the ends of thin, axial, metallic flanges 48 on the end-plates 18'',20''. This accommodates differences in thermal expansion. To provide enhanced fluid-cooling, metallic protruberances 50 are thermally bonded to anode end-plate 20. Protuberances 50 may be coaxial cylindrical fins. Alternatively they may be peripherally separated to enhance fluid turbulence as they rotate.

Figure 4:
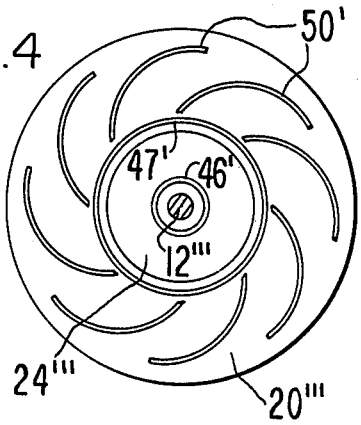
FIG. 4 is an end view of an alternative arrangement of the fins of FIG. 3.

As shown in FIG. 4 the protuberances may be shaped in the form of spiral fins 50' that simultaneously provide increased thermal contact between the fluid and the x-ray anode and also provide pumping action to the adjacent fluid to continuously bring fresh cool fluid into the region of thermal contact.

In the next section, calculations will be given as to possible operating parameters of the inventive tube. For a medical X-ray system such as a CAT scanner, one could use an electron current of 200 ma at 100 KV. The power in the light flux would have to be $$p_{light}=(Ih\nu)/(\eta e) \text{ watts}$$

where

I is the photoemitted current, 0.2 amperes h is Plancks' constant, $6.6\times10^{-34}$ joules/second $\nu$ is the light frequency, equal to $C/\nu$ where C is the velocity of light, $3\times10^{8}$ meters/second $\lambda$ is the wavelength, taken as 0.5 micron then $\nu=3\times10^{8}/0.5\times10^{-6}=6\times10^{14}$ cycles/second $h\nu=4.0\times10^{-19}$ joules/photon $\eta$ is the photoelectric particle efficiency in electrons per photon, typically about 0.4 in a high-efficiency photocathode e is the electron charge in coulombs, $1.6\times10^{-19}$ Putting these values into the above equation $p_{light}=1.25$ watts Xenon arc lamps have power efficiencies from 25 to 40%, with about 10% of the radiation having a wavelength below 0.7 microns and thus effective for photoemission (Reference "Solid State Laser Engineering" by W. Koechner, Springer-Verlag, N.Y. 1976). Thus we can assume an overall power efficiency $\eta_p=0.03$.

The geometric efficiency $\eta_s$ of collecting the light is given by $$\eta_s=(\text{area of lens})\div4\pi R^2,$$

where R is the distance from lamp to lens, for a 1.5 inch, 35 mm focal length lens, (f 1.0) lens radius a=3.5 cm, R=5 cm $$\eta_s=(\pi a^2)/4\pi R^2)=3.5^2/(4\times5^2)=0.12$$

The total lamp input electric power is than $P_e=P_{light}(\eta_s\eta_p)=1.25/0.03\times0.12=350$ watts. A commercially available 500 W Xenon lamp would be adequate.

The above calculations show that the inventive tube using a photocathode is possible using known techniques and materials. To keep the photocathode active will require a very high vacuum. However, the absence of both a hot cathode and moving bearings in the vacuum envelope remove two possible sources of gas and permits an excellent vacuum.

It will be recognized by those skilled in the art that many different embodiments may occur within the scope of the invention. For example, the window and/or one of the electrodes may be on an axially-extending surface of the vacuum chamber instead of on a flat end. Also, the transparent window may be part or all of the insulating portion of the vacuum envelope. It is only necessary that the axial symmetry be maintained. The invention is to be limited only by the following claims and their legal equivalents.

I claim:

1. An X-ray generating device comprising:

a vacuum envelope, the entire envelope being rotatable as a sealed unit about an axis, said envelope comprising: a metallic anode electrode having an X-ray emitting surface symmetric with respect to said axis, a photocathode electrode symmetric with respect to said axis spaced from and facing said anode, a window of optically transparent material located in said vacuum envelope for coupling light from a stationary source outside said vacuum envelope to said photocathode, and an insulator being a portion of said vacuum envelope between said anode and said photocathode, said anode and said cathode being fixed with respect to said envelope;

means for cooling said anode from outside said vacuum envelope including a heat conduction path from an exterior face of said envelope to said X-ray emitting surface;

means for rotating said vacuum envelope about said axis comprising at least one axial bearing;

means for focusing a beam of light from the stationary source outside said vacuum envelope through said window onto a first stationary region through which said photocathode is rotatable as the envelope is rotated by said means for rotating; and means for focusing a beam of photoelectrons from said first stationary region onto a second stationary region through which the X-ray emitting surface of said anode is rotatable as the envelope is rotated by said means for rotating.

2. The device of claim 1 wherein said window of optically transparent material is also part of said insulator.

3. The device of claim 1 wherein said means for focusing said beam of photoelectrons comprises means for supplying a stationary magnetic field between said first stationary region and said second stationary region.

4. The device of claim 1 wherein said means for focusing photoelectrons comprises electrostatic means.

5. The device of claim 1 wherein said photocathode is deposited on the inner surface of said window.

6. The device of claim 1 wherein said vacuum envelope is generally a closed cylinder about said axis.

7. The device of claim 6 wherein said photocathode is on one closed end of said cylinder and said anode is on the opposed closed end of said cylinder.

8. The device of claim 1 wherein said means for cooling of said anode includes metallic protuberances that are thermally bonded to said anode and extend on the external side of said vacuum envelope to provide increased thermal contact to an external cooling fluid.

9. The device of claim 8 wherein said metallic protuberances are in the shape of spiral fins.

10. The device of claim 1 wherein said photocathode comprises an annular region.

11. The device of claim 1 wherein said anode comprises an annular region.

12. The device of claim 1 wherein said means for rotating comprises opposed shafts rigidly attached to said vacuum envelope, said shafts being coaxial with said axis, one of said shafts being supported by said axial bearing.

13. The device of claim 12 wherein at least one of said shafts is metal and is electrically connected between a source of high voltage and one of said electrodes for supplying the high voltage to said one electrode.

* * * * *